US012577860B2

(12) United States Patent
Wu

(10) Patent No.: US 12,577,860 B2
(45) Date of Patent: Mar. 17, 2026

(54) GOLF-TYPE GAS LIFT BALL, GAS LIFT OIL RECOVERY DEVICE, CONTROL SYSTEM, AND CONTROL METHOD

(71) Applicants: Zheng Wu, Chengdu (CN); Yunxuan Wu, Chengdu (CN)

(72) Inventor: Zheng Wu, Chengdu (CN)

(73) Assignees: Zheng Wu; Yunxuan Wu, Chengdu (CN)

( * ) Notice: Subject to any disclaimer, the term of this patent is extended or adjusted under 35 U.S.C. 154(b) by 138 days.

(21) Appl. No.: 18/548,498

(22) PCT Filed: Mar. 23, 2022

(86) PCT No.: PCT/CN2022/082620
§ 371 (c)(1),
(2) Date: Aug. 30, 2023

(87) PCT Pub. No.: WO2022/199639
PCT Pub. Date: Sep. 29, 2022

(65) Prior Publication Data

US 2024/0141763 A1 May 2, 2024

(30) Foreign Application Priority Data

Mar. 25, 2021 (CN) ..... 202110321616.9
Mar. 25, 2021 (CN) ..... 202120613582.6
(Continued)

(51) Int. Cl.
*E21B 43/12* (2006.01)
*E21B 36/04* (2006.01)
(Continued)

(52) U.S. Cl.
CPC ..... *E21B 43/122* (2013.01); *E21B 43/123* (2013.01); *E21B 47/09* (2013.01);
(Continued)

(58) Field of Classification Search
CPC .... E21B 43/122; E21B 43/123; E21B 43/121; E21B 43/12; E21B 43/116; E21B 47/09;
(Continued)

(56) References Cited

U.S. PATENT DOCUMENTS 5,361,830 A 11/1994 Wicks, III et al.
5,671,813 A * 9/1997 Lima ..... E21B 23/08 166/372
(Continued)

FOREIGN PATENT DOCUMENTS

CN 2068147 U * 12/1990
CN 2189202 2/1995
(Continued)

OTHER PUBLICATIONS

Foreign Communication from a Related Counterpart Application, International Search Report and Written Opinion dated Jun. 9, 2022, International Application No. PCT/CN2022/082620 filed on Mar. 23, 2023.
(Continued)

*Primary Examiner* — George S Gray
(74) *Attorney, Agent, or Firm* — Conley Rose, P.C.

(57) ABSTRACT

A golf-type gas lift ball gas lift oil production device includes a golf-type gas lift ball, a ball retracting and pitching device and a multistage start-up device. A control system and a control method are configured to control the golf-type gas lift ball gas lift oil production device and link the golf-type gas lift ball, the ball retracting and pitching device and the multistage start-up device together.

20 Claims, 10 Drawing Sheets

(30) Foreign Application Priority Data

| | | |
|---|---|---|
| Aug. 18, 2021 | (CN) | 202110950759.6 |
| Aug. 18, 2021 | (CN) | 202121944884.8 |
| Dec. 6, 2021 | (CN) | 202111477316.6 |

(51) Int. Cl.

| | |
|---|---|
| ***E21B 43/116*** | (2006.01) |
| ***E21B 47/07*** | (2012.01) |
| ***E21B 47/09*** | (2012.01) |
| ***E21B 47/12*** | (2012.01) |

(52) U.S. Cl.
CPC ..... *E21B 47/12* (2013.01); *E21B 47/138* (2020.05); *E21B 36/04* (2013.01); *E21B 43/116* (2013.01); *E21B 47/07* (2020.05); *E21B 2200/04* (2020.05)

(58) Field of Classification Search
CPC ..... E21B 47/12; E21B 47/138; E21B 47/07; E21B 36/04
See application file for complete search history.

(56) References Cited

U.S. PATENT DOCUMENTS

| | | | | |
|---|---|---|---|---|
| 6,293,340 | B1 * | 9/2001 | Wu | E21B 43/123 166/243 |
| 6,352,109 | B1 | 3/2002 | Buckman, Sr. | |
| 2012/0211218 | A1 * | 8/2012 | Munoz | C23C 8/70 148/240 |
| 2015/0322753 | A1 | 11/2015 | Zimmerman, Jr. | |
| 2020/0102804 | A1 * | 4/2020 | Frazier | E21B 33/12 |
| 2020/0173256 | A1 * | 6/2020 | Boyd | E21B 43/121 |

FOREIGN PATENT DOCUMENTS

| | | | | |
|---|---|---|---|---|
| CN | 2254953 | | | 5/1997 |
| CN | 1187572 | A | | 7/1998 |
| CN | 2294327 | | | 10/1998 |
| CN | 2480543 | | | 3/2002 |
| CN | 2564745 | Y | * | 8/2003 |
| CN | 1563666 | A | | 1/2005 |
| CN | 2753877 | | | 1/2006 |
| CN | 200955377 | | | 10/2007 |
| CN | 101408098 | | | 4/2009 |
| CN | 201258727 | Y | * | 6/2009 |
| CN | 101476457 | | | 7/2009 |
| CN | 102031949 | | | 4/2011 |
| CN | 201972682 | | | 9/2011 |
| CN | 103939089 | | | 7/2014 |
| CN | 204035142 | | | 12/2014 |
| CN | 104794980 | | | 7/2015 |
| CN | 105507875 | | | 4/2016 |
| CN | 205135550 | | | 4/2016 |
| CN | 106761690 | | | 5/2017 |
| CN | 107304661 | | | 10/2017 |
| CN | 108071364 | | | 5/2018 |
| CN | 209117239 | | | 7/2019 |
| CN | 209195388 | | | 8/2019 |
| CN | 209764391 | | | 12/2019 |
| CN | 210483687 | | | 5/2020 |
| CN | 210715061 | | | 6/2020 |
| CN | 111502620 | | | 8/2020 |
| CN | 111980648 | | | 11/2020 |
| CN | 112196507 | | | 1/2021 |
| CN | 212359724 | | | 1/2021 |
| CN | 112324401 | | | 2/2021 |
| CN | 113027395 | A | | 6/2021 |
| CN | 113464102 | A | | 10/2021 |
| CN | 214532915 | U | | 10/2021 |
| CN | 113982544 | A | | 1/2022 |
| CN | 216305887 | | | 4/2022 |
| CN | 218894642 | | | 4/2023 |
| WO | 9850677 | A1 | | 11/1998 |
| WO | 2019054991 | | | 3/2019 |
| WO | 2022199639 | A1 | | 9/2022 |

OTHER PUBLICATIONS

Foreign Communication from a Related Counterpart Application, First Examination Opinion Notice dated Aug. 31, 2024, Japanese Application No. 2021109507596 filed on Aug. 18, 2021.
Foreign Communication from a Related Counterpart Application, Second Examination Opinion Notice dated Oct. 13, 2024, Japanese Application No. 2021109507596 filed on Aug. 18, 2021.
Foreign Communication from a Related Counterpart Application, Rejection Decision dated Nov. 28, 2024, Japanese Application No. 2021109507596 filed on Aug. 18, 2021.
Foreign Communication from a Related Counterpart Application, First Examination Opinion Notice dated Apr. 19, 2022, Japanese Application No. 2021103216169 filed on Mar. 25, 2021.
Foreign Communication from a Related Counterpart Application, First Examination Opinion Notice dated Sep. 19, 2024, Japanese Application No. 2021114773166 filed on Dec. 6, 2021.
Foreign Communication from a Related Counterpart Application, Patent Evaluation Report dated Apr. 29, 2022, Japanese Application No. 2021206135826 filed on Mar. 25, 2021.

* cited by examiner

GOLF-TYPE GAS LIFT BALL, GAS LIFT OIL RECOVERY DEVICE, CONTROL SYSTEM, AND CONTROL METHOD

CROSS-REFERENCE TO RELATED APPLICATIONS

The present application is a filing under 35 U.S.C. 371 as the National Stage of International Application No. PCT/CN2022/082620, filed Mar. 23, 2022, entitled "GOLF-TYPE GAS LIFT BALL, GAS LIFT OIL RECOVERY DEVICE, CONTROL SYSTEM, AND CONTROL METHOD," which claims priority to Chinese Application No. 202110321616.9 filed with the Intellectual Property Office of China on Mar. 25, 2021, Chinese Application No. 202120613582.6 filed with the Intellectual Property Office of China on Mar. 25, 2021, Chinese Application No. 202110950759.6 filed with the Intellectual Property Office of China on Aug. 18, 2021, Chinese Application No. 202121944884.8 filed with the Intellectual Property Office of China on Aug. 18, 2021, and Chinese Application No. 202111477316.6 filed with the Intellectual Property Office of China on Dec. 6, 2021, all of which are incorporated herein by reference in their entirety for all purposes.

TECHNICAL FIELD

The present disclosure relates to a golf-type gas lift ball gas lift oil production device, control system and method, involving the technical field of oil and gas lift equipment.

BACKGROUND

In light of the gas lift oil production devices commonly used at present, one way is to lift the crude oil flowing into the well to the ground surface by means of mixing the high-pressure gas injected into the well from the ground surface with the fluid generated in the oil layer in the well, to reduce the density of the mixed liquid in the well by the expansion of the gas. Another way is to pump the gas lift ball along the pipe string to the bottom of the well by use of the high-pressure gas, and then lift the oil to the ground surface by the thrust of the high-pressure gas and the gas lift ball. However, because the oil layer is usually located deep underground, with the continuous production of oil and gas, the downhole environment becomes complicated and unstable, such as frequent fluctuation in pressure, temperature and fluid flow rate at the bottom of the well. The traditional gas lift oil production device, however, cannot track the changes of the downhole conditions in real time, so it is not feasible to adjust the pumping rate of the injected high-pressure gas or the pitching frequency of the gas lift ball in time, thus affecting the gas lift oil production efficiency.

SUMMARY

The present disclosure relates to a golf-type gas lift ball gas lift oil production device, control system and method, to effectively solve these problems.

The embodiments of the present disclosure are realized by means of the following technical schemes:

In the first aspect, the present disclosure relates to a golf-type gas lift ball, wherein oil gas is lifted by injecting high-pressure gas in a gas lift tee which comprises a gas supply pipe, a gas lift pipe and a tailpipe; the golf-type gas lift ball comprises a spherical body with a diameter less than the inner diameters of the gas supply pipe and the gas lift pipe, together with a number of protrusions (hard pointed pieces or soft burrs) on the outer wall of the spherical body.

Further, the gas supply pipe and the gas lift pipe have the equal inner diameter, being 40.2 mm to 40.4 mm or 50.2 mm to 50.4 mm, preferably 40.3 mm or 50.3 mm.

If the gas supply pipe and the gas lift pipe have the equal inner diameter of 40.3 mm, the ball has a diameter of 36 mm to 37 mm, preferably 37 mm. If the gas supply pipe and the gas lift pipe have the equal inner diameter of 50.3 mm, the ball has a diameter of 46 mm to 47 mm, preferably 47 mm.

The outer diameter of the golf-type gas lift ball is less than the inner diameters of the gas supply pipe and the gas lift pipe when the protrusions are hard pointed pieces;

Further, if the gas supply pipe and the gas lift pipe have the equal inner diameter of 40.3 mm, the golf-type gas lift spherical body with hard pointed pieces has an outer diameter of 38 mm to 38.5 mm, preferably 38 mm. If the gas supply pipe and the gas lift pipe have the equal inner diameter of 50.3 mm, the golf-type gas lift spherical body with hard pointed pieces has an outer diameter of 48 mm to 48.5 mm, preferably 48 mm.

The outer diameter of the golf-type gas lift ball is more than or equal to the inner diameters of the gas supply pipe and the gas lift pipe when the protrusions are soft burrs that are deformed and attached to the inner wall of the gas lift pipe or the gas supply pipe;

Further, if the gas supply pipe and the gas lift pipe have the equal inner diameter of 40.3 mm, the golf-type gas lift ball with soft burrs has an outer diameter of 40.3 mm to 42 mm, preferably 41 mm. If the gas supply pipe and the gas lift pipe have the equal inner diameter of 50.3 mm, the golf-type gas lift ball with soft burrs has an outer diameter of 50.3 mm to 52 mm, preferably 51 mm.

The spherical body is hollow, an interconnecting hole is formed on the sidewall of the spherical body, a soft layer is arranged on the inner sidewall, and a first sensor consisting of a pressure sensor, a temperature sensor and/or a velocity sensor is embedded in the soft layer;

The soft layer can be made of cotton, rubber, silica gel, soft plastic etc.;

The first sensor comprises a mounting base and a sensing probe, wherein the mounting base is installed in the soft layer, and the sensing probe is not in contact with the soft layer.

In the second aspect, the present disclosure relates to a ball retrieving and pitching device for retrieving and pitching the golf-type gas lift ball, wherein the ball retrieving and pitching device comprises a housing, a ball inlet, a ball outlet, a gas outlet and an oil outlet are formed on the housing, the ball inlet is located above the ball outlet, a slide rail for the gas lift ball is formed between the ball inlet and the ball outlet, one end of the slide rail is connected with the ball inlet while the other end thereof is connected with the ball outlet, the inner diameter of the slide rail is more than the inner diameter of the ball outlet, a number of gaps are formed on the sidewall of the slide rail, and a low/high pressure conversion valve is installed outside the ball outlet.

The slide rail is spiral and consists of a conveyor pipe and an open slide rail, the open slide rail consists of circular rings and four metal bars, the circular rings are arranged at the ends of the metal bars, the four metal bars are arranged in an annular form, a number of supports with a number of fixed collars are arranged on the slide rail, the fixed collars are sleeved on the outer wall of the slide rail, and fixing rods are arranged among the fixed collars;

A hollow rod connected with a gas pipe is installed in the housing, and multiple exhaust holes are formed on the sidewall of the hollow rod;

An annular gas lift ball retrieving and storage device with the same inner diameter as that of the ball outlet is installed at the end of the slide rail, the gas lift ball retrieving and storage device fits with the ball outlet and is connected to an automatic telescopic rod which is installed at the inner bottom of the housing, the movement direction of the automatic telescopic rod is perpendicular to the axial direction of the gas lift ball retrieving and storage device, and the automatic telescopic rod is powered electrically or pneumatically;

The low/high pressure conversion valve comprises a first chamber and a second chamber which are serially connected, the first chamber is connected to the ball outlet, a first valve is arranged between the first chamber and the ball outlet, a second valve is arranged between the first chamber and the second chamber, a third valve is arranged at the bottom of the second chamber, a first high-pressure gas pump is connected to the second chamber, a pressure relief port at which a fourth valve is installed is formed on the sidewall of the second chamber, and all of the four valves can be one of solenoid valves, ball valves and pneumatic valves;

The low/high pressure conversion valve comprises a spherical and hollow housing, with a ball inlet channel, a ball outlet channel, a high-pressure gas channel and a residual oil channel formed on the sidewall of the spherical housing respectively; the inner diameter of the ball inlet channel is equal to that of the ball outlet channel, the inner diameter of the high-pressure gas channel is less than that of the ball inlet channel, and the inner diameter of the residual oil channel is less than that of the high-pressure gas channel; a round valve core fitting with the inner wall of the spherical housing is installed in the spherical housing, with a first through hole and a second through hole formed coaxially at the axis of the valve core; the first through hole and the ball inlet channel have the equal inner diameter, and the second through hole and the high-pressure gas channel have the equal inner diameter; a second high-pressure gas pump is connected to the high-pressure gas channel, a rotary actuator powered electrically or pneumatically to drive the valve core to rotate is installed outside the spherical housing, and specifically, the rotary actuator is a gear motor.

In the third aspect, the present disclosure relates to a multistage start-up device for multistage start-up in downhole operation of the golf-type gas lift ball, wherein the multistage start-up device comprises the gas lift tee, together with a number of gas lift valves arranged at the lengthwise direction of the gas lift tee;

The gas lift tee is in a Y shape, and comprises the gas supply pipe, the gas lift pipe and the tailpipe;

The gas lift valve is in an H shape, and comprises a first channel, a second channel and a third channel, wherein the first channel is connected to the gas supply pipe, the second channel is connected to the gas lift pipe, the first channel and the second channel are connected together by the third channel, and the third channel is internally provided with a movable gate.

A sealing chamber with a fixed plate and a movable plate inside is arranged at the top of the third channel, a telescopic part is arranged between the fixed plate and the movable plate, a third through hole is formed between the sealing chamber and the third channel, the movable gate is of a plate gate which passes through the third through hole, one end of the plate gate is fixedly connected to the movable plate, while the other end thereof is of a free end at which a stop block is arranged.

The telescopic part is a spring;

A pressure transfer hole located at the side of the plate gate close to the second channel is formed between the sealing chamber and the third channel;

The telescopic part is motor-driven;

A first pressure sensor and a first PLC controller are arranged on the inner sidewall of the second channel respectively, wherein a signal output end of the first pressure sensor is connected to a signal input end of the first PLC controller, and the signal output end of the first PLC controller is connected to the signal input end of the motor-driven telescopic part;

The movable gate is of a cylinder gate which consists of a valve core and a valve casing; the valve core and the valve casing are arranged coaxially, the valve core can rotate about an axis in the valve casing, and the outer wall of the valve core fits with the inner wall of the valve casing; a fourth through hole is formed on the valve core at a direction perpendicular to the axis, and slots fitting with the fourth through hole are formed symmetrically at both sides of the valve casing;

A second pressure sensor and a second PLC controller are arranged on the inner sidewall of the second channel respectively, wherein the signal output end of the second pressure sensor is connected to the signal input end of the second PLC controller, and the signal output end of the second PLC controller is connected to the signal input end of the cylinder gate;

A perforating gun and a sleeve are arranged at the lower end of the tailpipe;

The perforating gun is cylindrical, a first cable is arranged at the tail of the perforating gun, a number of storage grooves with perforating bullets inside are formed on the sidewall of the perforating gun, initiators are arranged at the tails of the perforating bullets, located at the central axis of the perforating gun and arranged in an annular form, fuses are embedded at the central axis of the perforating gun and pass through the inside of the initiators, and curved plates made of ductile metals are arranged at the openings of the storage grooves;

The sleeve with a heater inside is sleeved outside the perforating gun, wherein a second cable is connected to the heater, a heating wire with one end fixedly connected to the heater and the other end fixedly connected to the curved plates is arranged between the sleeve and the perforating gun, a number of perforating bullet outlets are formed on the sidewall of the sleeve, the perforating bullet outlets fit with the storage grooves, and metal foils are arranged at the perforating bullet outlets.

The curved plates are fixed at the openings of the storage grooves or the perforating bullet outlets by means of spot-welding.

A number of first motor-driven telescopic rods are arranged on the outer sidewall of the perforating gun, and a number of recesses fitting with the first motor-driven telescopic rods are formed on the inner sidewall of the sleeve; a number of second motor-driven telescopic rods are arranged on the outer sidewall of the sleeve, and burrs are formed at the ends of the second motor-driven telescopic rods.

In the fourth aspect, the present disclosure relates to a golf-type gas lift ball gas lift oil production device which consists of a golf-type gas lift ball, a ball retrieving and pitching device and a multistage start-up device.

In the fifth aspect, the present disclosure relates to an intelligent control system of the golf-type gas lift ball gas lift oil production device, for controlling the golf-type gas lift ball gas lift oil production device and linking the golf-type gas lift ball, the ball retrieving and pitching device and the multistage start-up device together, wherein the intelligent control system comprises:

A first sensor embedded in the golf-type gas lift ball and designed to collect dynamic position data;

A signal trigger unit designed to trigger the first sensor to send out signals;

A radio signal receiver designed to receive radio signals from the first sensor and convert these signals into digital signals;

An intelligent controller designed to receive digital signals from the radio signal receiver and generate control instructions;

An execution module designed to convert the control instructions from the intelligent controller for the ball retrieving and pitching device to automatically pitch the ball and the high-pressure gas pump to automatically inject gas;

A control panel designed to display the system status and enter control data;

A signal sending and receiving module designed to send the dynamic position data collected to a platform or the ground surface in the form of radio signals, and receive the control instructions from the platform or the ground surface.

In the sixth aspect, the present disclosure relates to an intelligent control method of the golf-type gas lift ball gas lift oil production device, for controlling the golf-type gas lift ball gas lift oil production device and linking the golf-type gas lift ball, the ball retrieving and pitching device and the multistage start-up device together, wherein the intelligent control method comprises:

S1. Collect dynamic downhole data;

The dynamic position data include pressure, temperature and moving velocity of the ball;

S2. According to the data collected in S1, adjust the pitching frequency of a ball control device and the gas injection pressure of a high-pressure gas source;

X=pressure, Y=temperature and Z=velocity;

A=pitching frequency of the ball retrieving and pitching device and B=gas injection pressure of the high-pressure gas pump.

The technical schemes in the embodiments of the present disclosure at least have the following advantages and beneficial effects:

The present disclosure relates to a golf-type gas lift ball gas lift oil production device, and a control system and a control method for the golf-type gas lift ball gas lift oil production device; the golf-type gas lift ball gas lift oil production device comprises three parts: a golf-type gas lift ball, a ball retrieving and pitching device and a multistage start-up device.

The golf-type gas lift ball, the first part, can freely move in the gas lift tee to lift the oil and gas at the tailpipe to the ground surface, and can also effectively form a treadmill effect as the diameter of the spherical body is less than the pipe diameter. Moreover, with hard pointed pieces or soft burrs formed at the outer sidewall of the golf-type gas lift ball, wax accumulated on the inner wall of the gas lift tee can be timely removed;

The ball retrieving and pitching device, the second part, is simply constructed, and can effectively retrieve and pitch the golf-type gas lift ball, to bring about a good gas lift ball oil production efficiency. Moreover, in light of the ball retrieving and pitching device, the slide rail for the gas lift ball consists of two circular rings and a number of metal bars, so that the gas lift balls can only move in an orderly manner in the space formed by the metal bars with no congestion. With this kind of construction, it is easier to throw oil off from the surface of the moving gas lift ball under the centrifugal force, so that the gas lift ball can be cleaned before being used in the well again;

The multistage start-up device, the third part, has a multistage gas lift valve arranged at the gas lift tee, to realize the liquid drainage in stages. Under the treadmill effect of the gas lift ball, liquid can be drained quickly, efficiently and more completely. Moreover, by virtue of the liquid drainage in stages, the flow pressures of each stage can be reduced significantly, and the total amplitude of reduction in the flow pressure at the bottom of the well can be dramatically increased, so that the oil and gas at the bottom of the well can be lifted in stages to the ground surface under a lower start-up pressure. The multistage start-up device is applicable to gas lift oil production in a deep well. With a device arranged at the lower end of the multistage start-up device, the heating wire and the curved plate can be moved into the formation fractures by use of the perforating bullets, to heat the thick oil in formation fractures, thereby effectively improving the fluidity of the thick oil and the production efficiency of the oil and gas.

With the control method and the control system provided for the golf-type gas lift ball gas lift oil production device, downhole data involving temperature, pressure, velocity etc. are collected in real time and taken as bases to adjust the pitching frequency of the ball control device on the ground surface and the gas injection pressure of the high-pressure gas source, to improve the gas lift oil production efficiency. In addition, the control system can also operate intelligently and efficiently with the functions of remote data transmission and remote control.

BRIEF DESCRIPTION OF THE DRAWINGS

To give a clearer description of the technical schemes in the embodiments of the present disclosure, the drawings used in the description of the embodiments are briefly described below. It is to be understood that the subsequent drawings only illustrate part of embodiments of the present disclosure, and therefore shall not be construed as limiting the scope. Those of ordinary skill in the art may obtain other drawings based on the drawings described below on the premise that no creative work is done.

Figure 1:
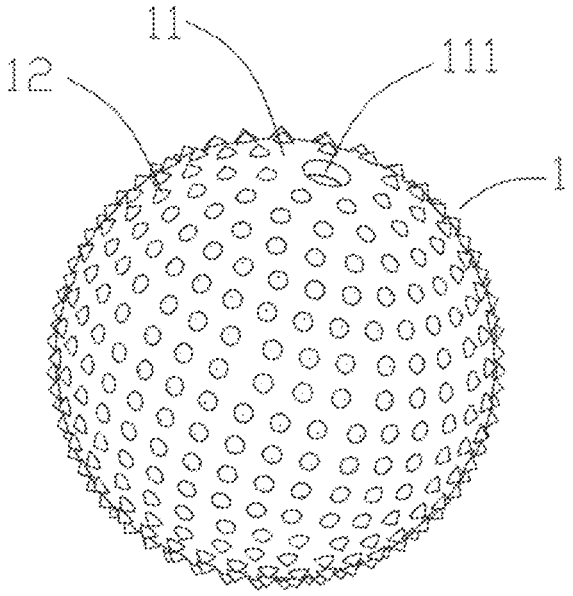
FIG. 1 is a structural schematic diagram of the golf-type gas lift ball in Embodiment 1 of the present disclosure.

Legend keys: 1—golf-type gas lift ball, 11—spherical body, 111—interconnecting hole, 112—soft layer, 113—first sensor, 12—hard pointed pieces, 13—soft burrs, 2—ball retrieving and pitching device, 21—housing, 211—ball inlet, 212—gas outlet, 213—ball outlet, 214—oil outlet, 22—slide rail for gas lift ball, 221—conveyor pipe, 222—open slide rail, 223—support, 2231—fixed collar, 2232—fixing rod, 23—hollow rod, 231—exhaust hole, 24—gas lift ball retrieving and storage device, 241—automatic telescopic rod, 25—low/high pressure conversion valve, 251—first chamber, 2511—liquid pumping pipe, 252—second chamber, 2521—pressure relief port, 2522—fourth valve, 253—first valve, 254—second valve, 255—third valve, 256—first high-pressure gas pump, 26—new low/high pressure conversion valve, 261—spherical housing, 2611—ball inlet channel, 2612—ball outlet channel, 2613—high-pressure gas channel, 2614—residual oil channel, 262—valve core, 2621—first through hole, 2622—second through hole, 3—type I multistage start-up device, 31—gas lift tee, 311—gas lift pipe, 312—gas supply pipe, 313—tailpipe, 32—gas lift valve, 321—first channel, 322—second channel, 323—third channel, 3231—plate gate, 32311—stop block, 3232—cylinder gate, 32321—valve core, 323211—fourth through hole, 32322—valve casing, 324—sealing chamber, 3241—fixed plate, 3242—movable plate, 3243—bellows, 3244—spring, 3245—third through hole, 3246—pressure transfer hole, 3247—motor-driven telescopic part, 4—perforating gun, 41—storage groove, 411—curved plate, 42—perforating bullet, 421—initiator, 43—fuse, 44—first motor-driven telescopic rod, 5—sleeve, 51—heater, 52—heating wire, 53—perforating bullet outlet, 531—metal foil, 54—recess, 55—second motor-driven telescopic rod, 6—first cable, and 7—second cable.

DESCRIPTION OF EMBODIMENTS

To illustrate purposes, technical solutions, and advantages in embodiments of the present disclosure, technical solutions of embodiments of the present disclosure are hereinafter described clearly and completely with reference to accompanying drawings in the embodiments of the present disclosure. Evidently, the described embodiments are only part rather than all of the embodiments of the present disclosure. Generally, the components in the embodiments of the present disclosure described and illustrated in the drawings herein may be arranged and designed through various configurations.

Therefore, the following detailed description of the embodiments of the present disclosure shown in the drawings is not intended to limit the scope of the present disclosure, but merely illustrates the selected embodiments of the present disclosure. All other embodiments obtained by those skilled in the art based on the embodiments of the present disclosure without creative efforts will fall within the protection scope of the present disclosure.

Embodiment 1

Figure 2:
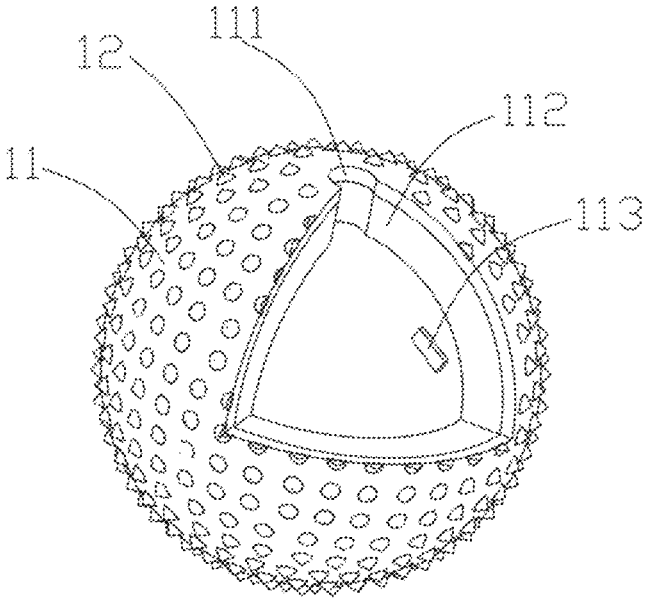
FIG. 2 is an internal structural schematic diagram of the golf-type gas lift ball shown in FIG. 1.

As shown in FIGS. 1 to 2, this Embodiment relates to a golf-type gas lift ball 1, for lifting the oil and gas with power provided by high-pressure gas in the gas lift tee, wherein the gas lift tee can be of a conventional tee structure comprising a gas supply pipe, a gas lift pipe and a tailpipe. The golf-type gas lift ball 1 comprises a spherical body 11 and a number of protrusions formed on the outer sidewall of the spherical body 11, wherein the spherical body 11 is made of hard rubber, the protrusions are hard pointed pieces 12, the hard pointed pieces 12 are also made of hard rubber, the diameter of the spherical body 11 is less than the inner diameter of the gas supply pipe, the diameter of the spherical body 11 is less than the inner diameter of the gas lift pipe, the outer diameter of the golf-type gas lift ball 1 is less than the inner diameter of the gas supply pipe, and the outer diameter of the golf-type gas lift ball 1 is less than the inner diameter of the gas lift pipe. Specifically, the gas supply pipe and the gas lift pipe have the equal inner diameter of 40.3 mm, the spherical body 11 has a diameter of 37 mm, and the golf-type gas lift ball 1 (including the hard pointed pieces 12) has a diameter of 38 mm.

Moreover, the spherical body 11 of the golf-type gas lift ball 1 in this Embodiment is hollow, with one or more through holes 111 formed on the sidewall of the spherical body 11. In this Embodiment, one through hole is taken as the example, that is, with the through hole 111, oil and gas can enter the spherical body 11, to balance the pressures inside and outside the spherical body 11. A soft layer 112 made of rubber is formed on the inner sidewall of the spherical body 11, with a first sensor 113 embedded in the soft layer 112, wherein this sensor is of an integrated sensor capable of monitoring pressure, temperature and velocity at the same time. The first sensor 113 comprises a mounting base and a sensing probe, with the mounting base installed in the soft layer 112 and the sensing probe not in contact with the soft layer 112. With this construction, the sensing probe can fully touch the oil and gas.

Embodiment 2

Figure 3:
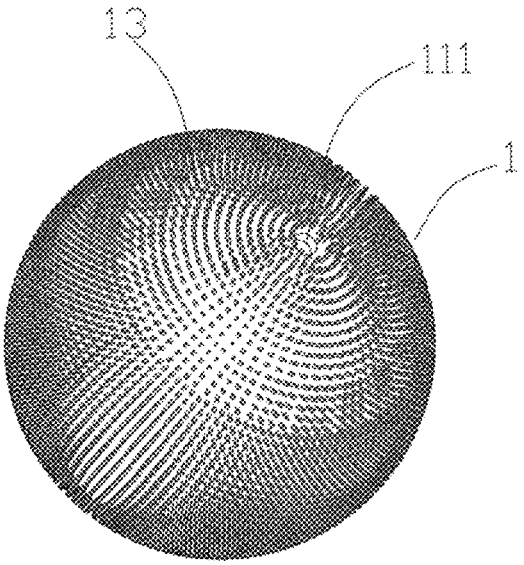
FIG. 3 is a structural schematic diagram of the golf-type gas lift ball in Embodiment 2 of the present disclosure.
Figure 4:
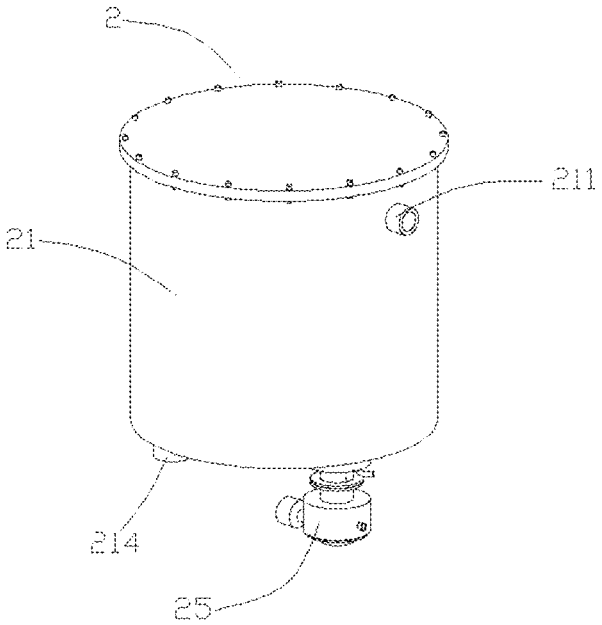
FIG. 4 is a structural schematic diagram of the ball retrieving and pitching device in Embodiment 3 of the present disclosure.
Figure 5:
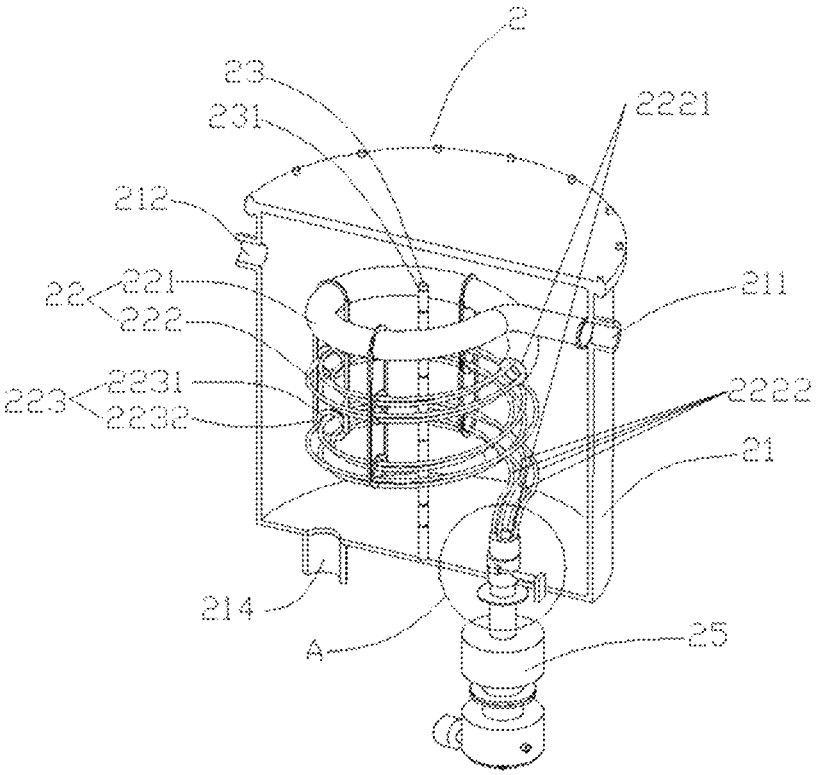
FIG. 5 is an internal structural schematic diagram of the ball retrieving and pitching device shown in FIG. 4.
Figure 6:
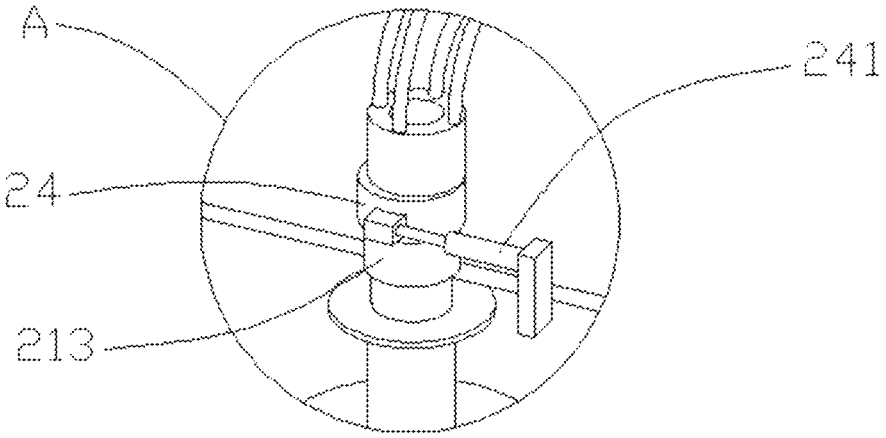
FIG. 6 is a structural schematic diagram of point A shown in FIG. 5.
Figure 7:
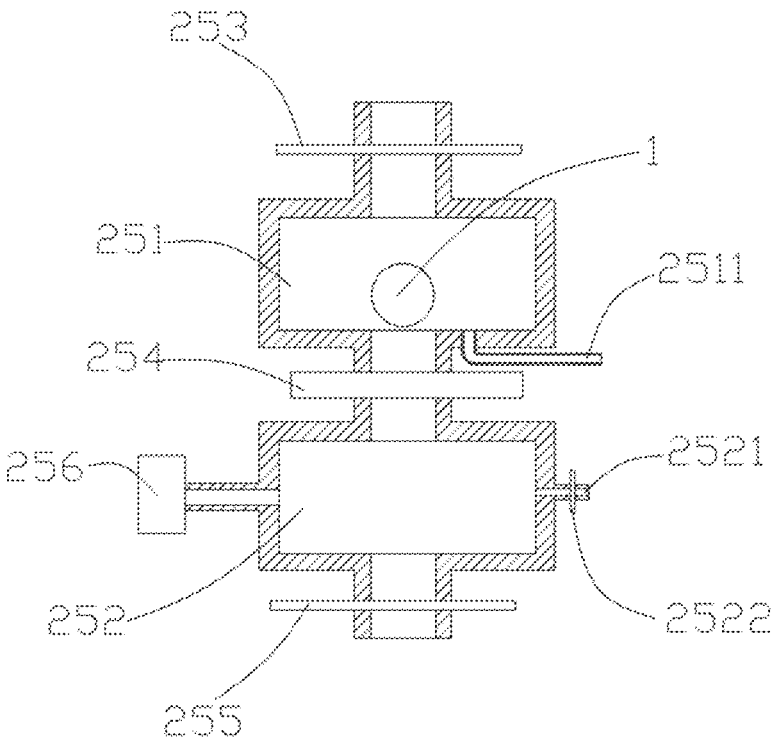
FIG. 7 is a structural schematic diagram of the low/high pressure conversion valve in the ball retrieving and pitching device shown in FIG. 4.

As shown in FIG. 3, this Embodiment relates to an alternative to Embodiment 1. This Embodiment has basically the same characteristics as Embodiment 1, except for that the protrusions are soft burrs 13, wherein the soft burrs 13 are made of soft rubber, the outer diameter of the golf-type gas lift ball 1 is more than the inner diameter of the gas supply pipe, and the outer diameter of the golf-type gas lift ball 1 is more than the inner diameter of the gas lift pipe. Specifically, the gas supply pipe and the gas lift pipe have the equal inner diameter of 40.3 mm, the spherical body 11 has a diameter of 37 mm, and the golf-type gas lift ball 1 (including the soft burrs 13) has a diameter of 41 mm. The soft burrs 13, once entering the gas supply pipe or the gas lift pipe, are deformed and attached to the inner sidewall.

Embodiment 3

As shown in FIGS. 4 to 7, this Embodiment relates to a ball retrieving and pitching device 2 for retrieving and pitching the golf-type gas lift ball 1, wherein the ball retrieving and pitching device 2 comprises a housing 21, a ball inlet 211 and a gas outlet 212 are formed on the sidewall of the housing 21, a ball outlet 213 and an oil outlet 214 are formed at the bottom of the housing 21, a slide rail 22 for the gas lift ball and a hollow rod 23 are provided in the housing 21, the slide rail 22 is spiral and consists of a conveyor pipe 221 and an open slide rail 222, the open slide rail 222 consists of circular rings 2221 and four metal bars 2222, the circular rings are arranged at the ends of the metal bars, the four metal bars are arranged in an annular form, a number of supports 223 with a number of fixed collars 2231 are arranged on the slide rail 22, the fixed collars 2231 are sleeved on the outer wall of the slide rail 22, and fixing rods 2232 are arranged among the fixed collars 2231. With this construction, in the conveyor pipe 221, the golf-type gas lift ball 1 can be pushed by the high-pressure gas to move forward. When the golf-type gas lift ball 1 is moved to the open slide rail 222, the high-pressure gas is relieved, so that the golf-type gas lift ball 1 can move under inertia and gravity, and during this process, oil and gas flow to the bottom inside the housing 21. One end of the slide rail 22 is installed at the ball inlet 211, and the other end of the slide rail 22 is installed at the ball outlet 213. An annular gas lift ball retrieving and storage device 24 is arranged between the ball outlet 213 and the end of the slide rail 22, wherein the inner diameter of the gas lift ball retrieving and storage device 24 is more than that of the ball outlet 213, the gas lift ball retrieving and storage device 24 fits with the ball outlet 213, and the gas lift ball retrieving and storage device 24 is connected with an automatic telescopic rod 241. The automatic telescopic rod 241 is powered pneumatically and installed at the bottom inside the housing 21. The hollow rod 23 is arranged at the center of the spiral slide rail 22. A number of exhaust holes 231 are formed on the sidewall of the hollow rod 23. The hollow rod 23 is connected with the gas pipe (at the bottom outside the housing. The gas pipe is not shown in these Figures). A low/high pressure conversion valve 25 is installed outside the ball outlet 213. The low/high pressure conversion valve 25 consists of a first chamber 251 and a second chamber 252, wherein the first chamber 251 and the second chamber 252 are serially connected, the first chamber 251 is connected to the ball outlet 213, a liquid pumping pipe 2511 is installed at the bottom of the first chamber 251, and a suction pump is externally connected to the liquid pumping pipe 2511, to pump out the liquid from the first chamber 251. A first valve 253 is arranged between the first chamber 251 and the ball outlet 213, a second valve 254 is arranged between the first chamber 251 and the second chamber 252, a third valve 255 is arranged at the bottom of the second chamber 252, a first high-pressure gas pump 256 is connected to the second chamber 252, a pressure relief port 2521 is formed on the sidewall of the second chamber 252, and a fourth valve 2522 is installed at the pressure relief port 2521.

Embodiment 4

Figure 8:
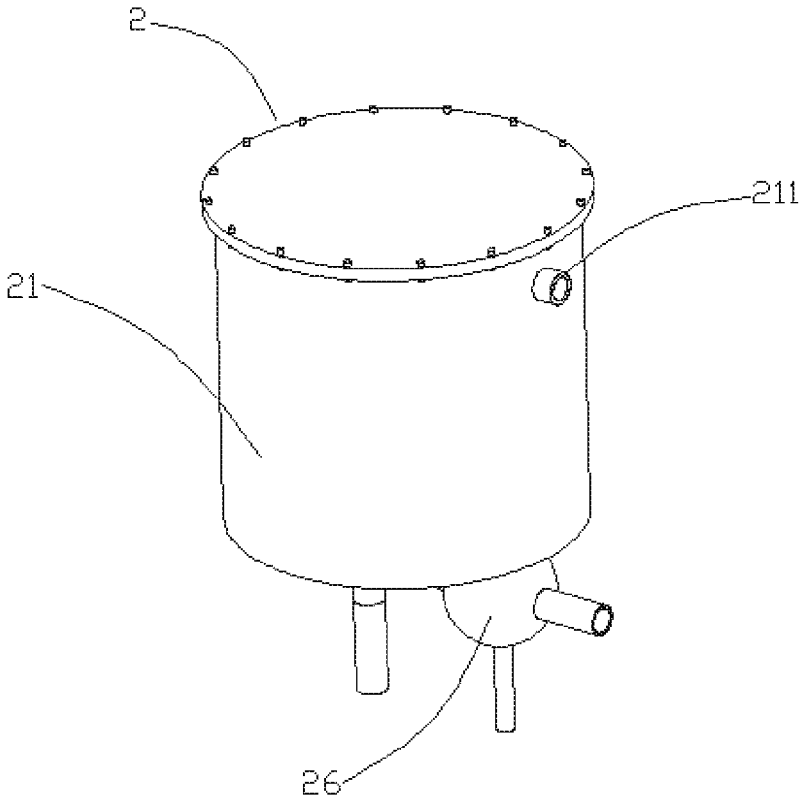
FIG. 8 is a structural schematic diagram of the ball retracting and pitching device in Embodiment 4 of the present disclosure.
Figure 9:
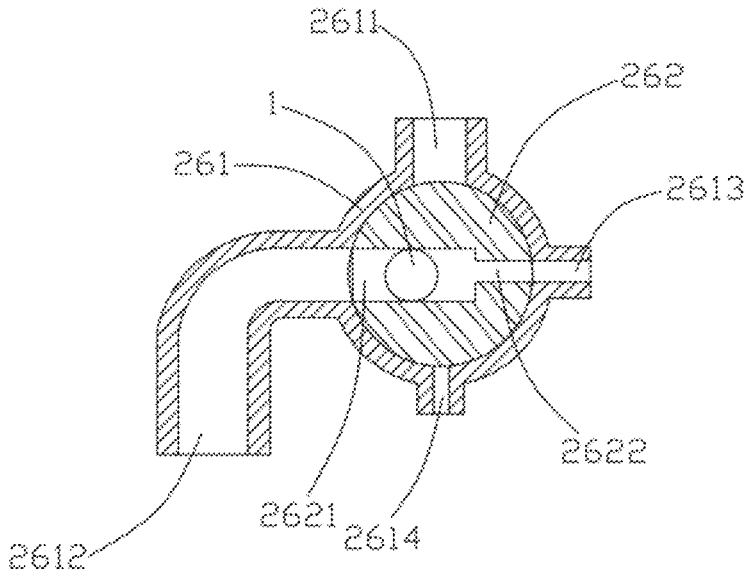
FIG. 9 is a structural schematic diagram of a new low/high pressure conversion valve in the ball retrieving and pitching device shown in FIG. 8.

As shown in FIGS. 8 to 9, this Embodiment relates to an improvement to Embodiment 3. This Embodiment has basically the same characteristics as Embodiment 1, except for that a new low/high pressure conversion valve 26 with a different construction is provided. Specifically, the new low/high pressure conversion valve 26 comprises a spherical and hollow housing 261, with a ball inlet channel 2611, a ball outlet channel 2612, a high-pressure gas channel 2613 and a residual oil channel 2614 formed on the sidewall of the spherical housing 261 respectively; the ball inlet channel 2611 is connected to the ball outlet 213 of the housing 21; the inner diameter of the ball inlet channel 2611 is equal to that of the ball outlet channel 2612, the inner diameter of the high-pressure gas channel 2613 is less than that of the ball inlet channel 2611, and the inner diameter of the residual oil channel 2614 is less than that of the high-pressure gas channel 2613; a round valve core 262 fitting with the inner wall of the spherical housing 261 is installed in the spherical housing 261, with a first through hole 2621 and a second through hole 2622 formed coaxially at the axis of the valve core 262; the first through hole 2621 and the ball inlet channel 2611 have the equal inner diameter, and the second through hole 2622 and the high-pressure gas channel 2613 have the equal inner diameter; a second high-pressure gas pump (not shown in the Figures) is connected to the high-pressure gas channel 2613, a gear motor (not shown in the Figures) is arranged outside the 261, and the output end of the gear motor is connected to the valve core 262, to drive the valve core 262 to rotate.

Embodiment 5

Figure 10:
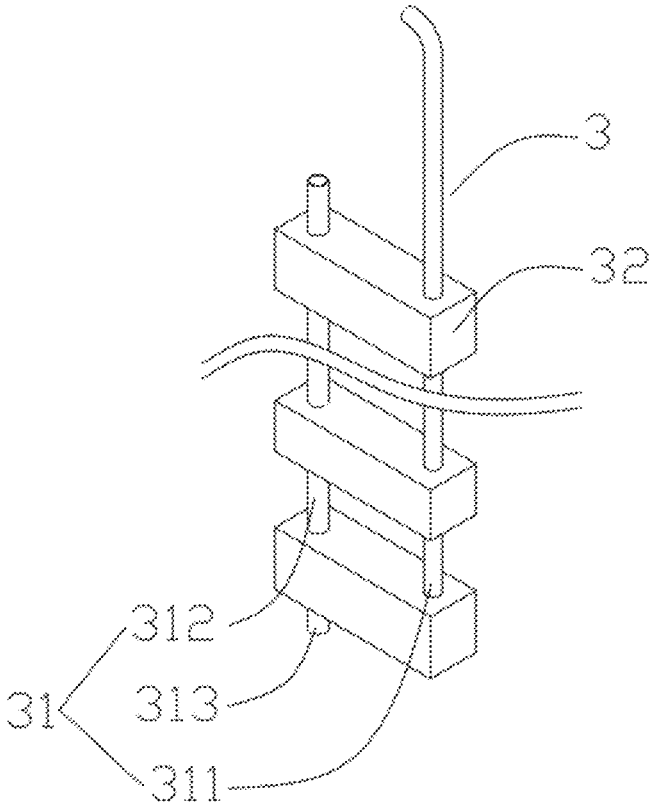
FIG. 10 is a structural schematic diagram of a type I multistage start-up device in Embodiment 5 of the present disclosure.
Figure 11:
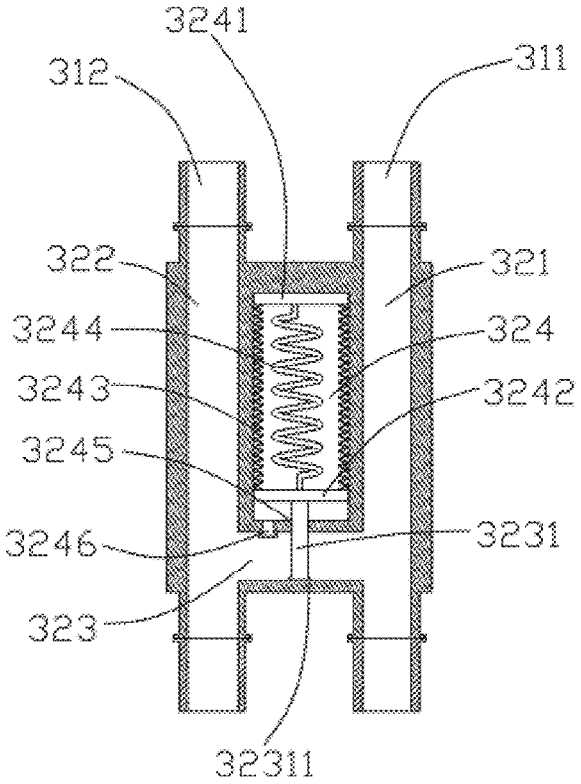
FIG. 11 is a structural schematic diagram of the gas lift valve in the type I multistage start-up device shown in FIG. 10.

As shown in FIGS. 10 to 11, this Embodiment relates to a type I multistage start-up device 3, comprising a gas lift tee 31 and a number of gas lift valves 32, wherein the gas lift valves 32 are arranged at the lengthwise direction of the gas lift tee 31; the gas lift tee 31 is in a Y shape, and comprises a gas lift pipe 311, a gas supply pipe 312 and a tailpipe 313; the gas lift valve 32 is in an H shape, and comprises a first channel 321, a second channel 322 and a third channel 323, wherein the first channel 321 is connected to the gas lift pipe 311, and the second channel 322 is connected to the gas supply pipe 312; for the gas lift valve 32 at the tailpipe 313 of the gas lift tee 31, one end of the first channel 321 is connected to the gas lift pipe 311 while the other end thereof is tightly sealed, and one end of the second channel 322 is connected to the gas supply pipe 312 while the other end thereof is connected to the tailpipe 313; the first channel 321 and the second channel 322 are connected together by the third channel 323, and the third channel 323 is internally provided with a plate gate 3231; a sealing chamber 324 with a fixed plate 3241 and a movable plate 3242 inside is arranged at the top of the third channel 323, wherein a telescopic part and a bellows 3243 are arranged between the fixed plate 3241 and the movable plate 3242, and the telescopic part is a spring 3244. It shall be noted that in light of a number of the gas lift valves, the deeper the gas lift valve at the depth direction of the gas lift tee is, the greater the coefficient of elasticity of the spring in the gas lift valve will be. This is because the deeper the gas lift valve is, the greater the fluid pressure will be. Therefore, springs with a greater coefficient of elasticity are required. The spring 3244 is arranged inside the bellows 3243, a third through hole 3245 is formed between the sealing chamber 324 and the third channel 323, the plate gate 3231 passes through the third through hole 3245, one end of the plate gate 3231 is fixedly connected to the movable plate 3242 while the other end thereof is of a free end at which a stop block 32311 is arranged, and a pressure transfer hole 3246 located at the side of the plate gate 3231 close to the second channel 322 is formed between the sealing chamber 324 and the third channel 323.

Embodiment 6

Figure 12:
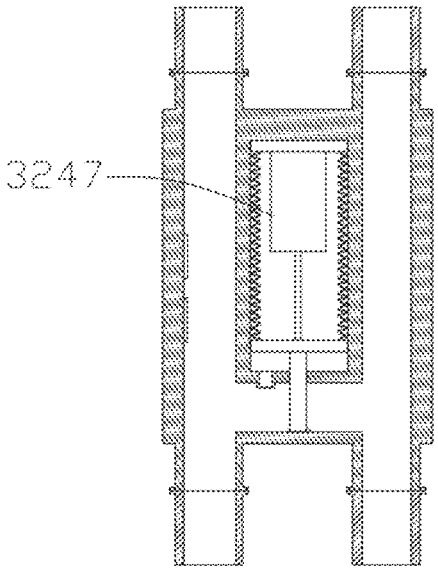
FIG. 12 is a structural schematic diagram of the gas lift valve in a type II multistage start-up device in Embodiment 6 of the present disclosure.

As shown in FIG. 12, this Embodiment relates to a type II multistage start-up device as an improvement to Embodiment 5. This Embodiment has basically the same characteristics as Embodiment 5, except for that the spring 3244 is changed to a motor-driven telescopic part 3247, and a first pressure sensor and a first PLC controller are arranged on the inner sidewall of the second channel 322, wherein a signal output end of the first pressure sensor is connected to a signal input end of the first PLC controller, a signal output end of the first PLC controller is connected to a signal input end of the motor-driven telescopic part 3247, and the motor-driven telescopic part 3247, the first pressure sensor and the first PLC controller are all powered by cables in the hole.

Embodiment 7

Figure 13:
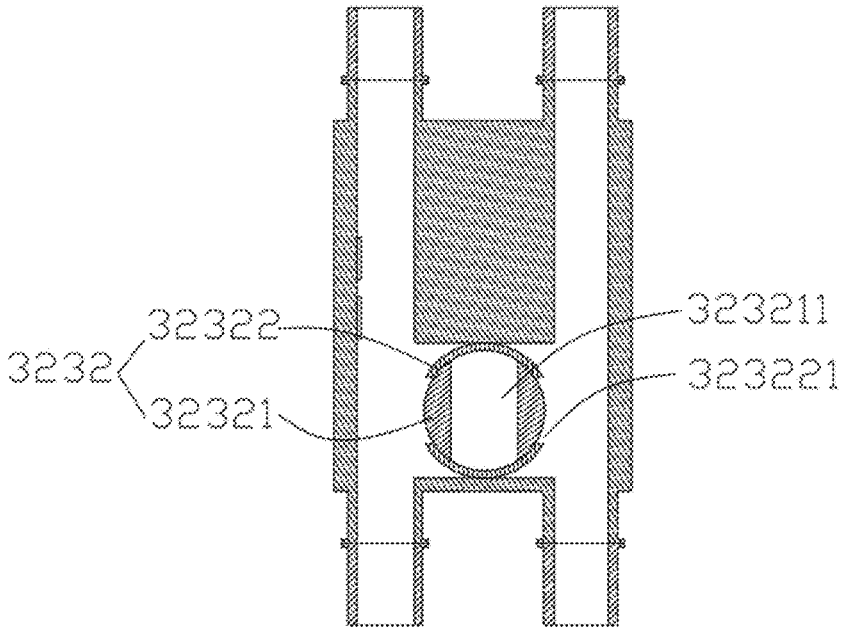
FIG. 13 is a structural schematic diagram of the gas lift valve in a type Ill multistage start-up device in Embodiment 7 of the present disclosure.

As shown in FIG. 13, this Embodiment relates to a type III multistage start-up device as an improvement to Embodiment 5. This Embodiment has basically the same characteristics as Embodiment 5, except for that there is no sealing chamber 324 and the plate gate 3231 is changed to a cylinder gate 3232, wherein the cylinder gate 3232 consists of a valve core 32321 and a valve casing 32322 arranged coaxially; the valve core 32321 can rotate about an axis in the valve casing 32322, and the outer wall of the valve core 32321 fits with the inner wall of the valve casing 32322; a fourth through hole 323211 is formed on the valve core 32321 at a direction perpendicular to the axis, and slots 323221 fitting with the fourth through hole 323211 are formed symmetrically at both sides of the valve casing 32322; In addition, a second pressure sensor and a second PLC controller are arranged on the inner sidewall of the second channel 322, wherein a signal output end of the second pressure sensor is connected to a signal input end of the second PLC controller, a signal output end of the second PLC controller is connected to a signal input end of the cylinder gate, and the cylinder gate 3232, the second pressure sensor and the second PLC controller are all powered by cables in the well.

Embodiment 8

Figure 14:
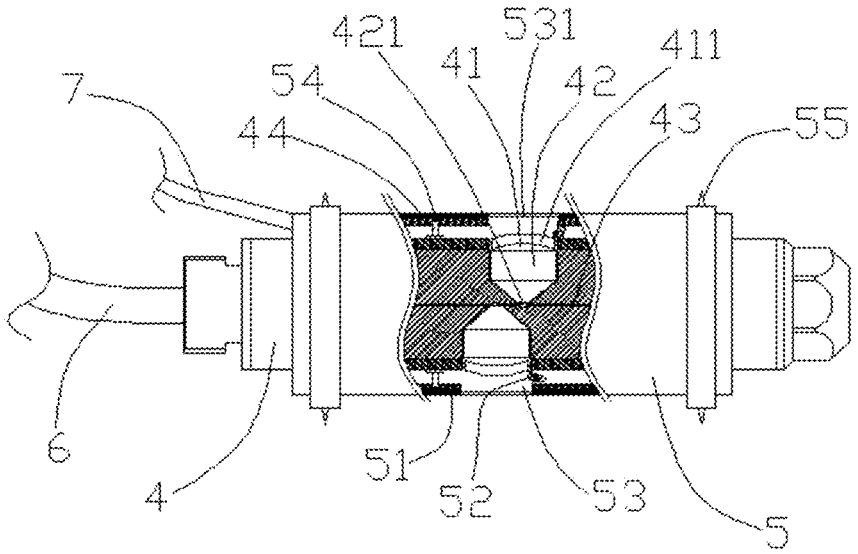
FIG. 14 is a structural schematic diagram of the perforating gun and the sleeve in Embodiment 8 of the present disclosure.
Figure 15:
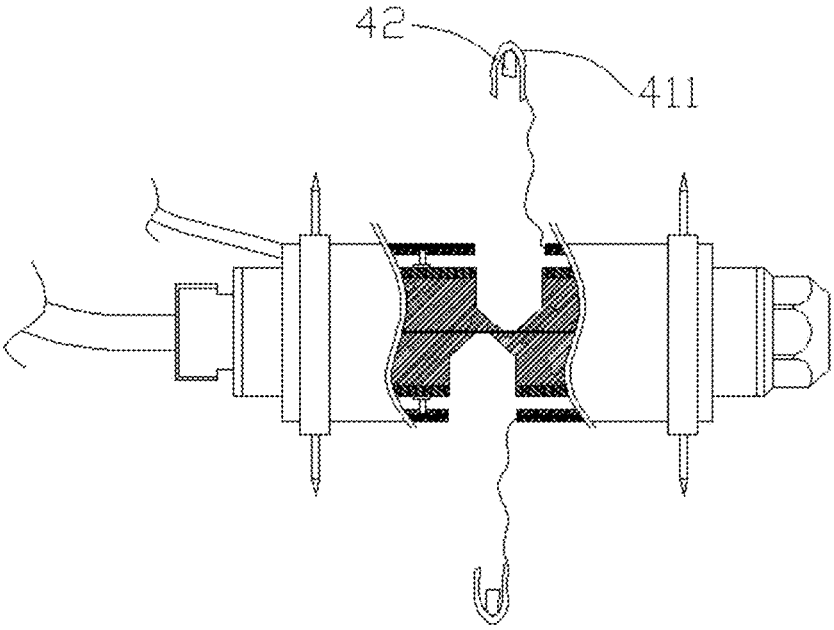
FIG. 15 is a structural schematic diagram after perforating operation with the perforating gun and release of the sleeve shown in FIG. 14.

As shown in FIGS. 14 to 15, as an improvement to Embodiment 5, a perforating gun 4 and a sleeve 5 are arranged at the lower end of the tailpipe 313 of the type I multistage start-up device 3, wherein the perforating gun 4 is cylindrical, a first cable 6 is arranged at the tail of the perforating gun 4, a number of storage grooves 41 with perforating bullets 42 inside are formed on the sidewall of the perforating gun 4, initiators 421 are arranged at the tails of the perforating bullets 42, located at the central axis of the perforating gun 4 and arranged in an annular form, fuses 43 are embedded at the central axis of the perforating gun 4 and pass through the inside of the initiators 421, and curved plates 411 made of ductile metals (copper) are arranged at the openings of the storage grooves 41; the sleeve 5 with a heater 51 inside is sleeved outside the perforating gun 4, wherein a second cable 7 is connected to the heater 51, a heating wire 52 with one end fixedly connected to the heater 51 and the other end fixedly connected to the curved plates 411 is arranged between the sleeve 5 and the perforating gun 4, a number of perforating bullet outlets 53 are formed on the sidewall of the sleeve 5, the perforating bullet outlets 53 fit with the storage grooves 41, and metal foils 531 are arranged at the perforating bullet outlets 53.

A number of first motor-driven telescopic rods 44 are arranged on the outer sidewall of the perforating gun 4, and a number of recesses 54 fitting with the first motor-driven telescopic rods 44 are formed on the inner sidewall of the sleeve 5; a number of second motor-driven telescopic rods 55 are arranged on the outer sidewall of the sleeve 5, and burrs are formed at the ends of the second motor-driven telescopic rods 55.

Embodiment 9

Figure 16:
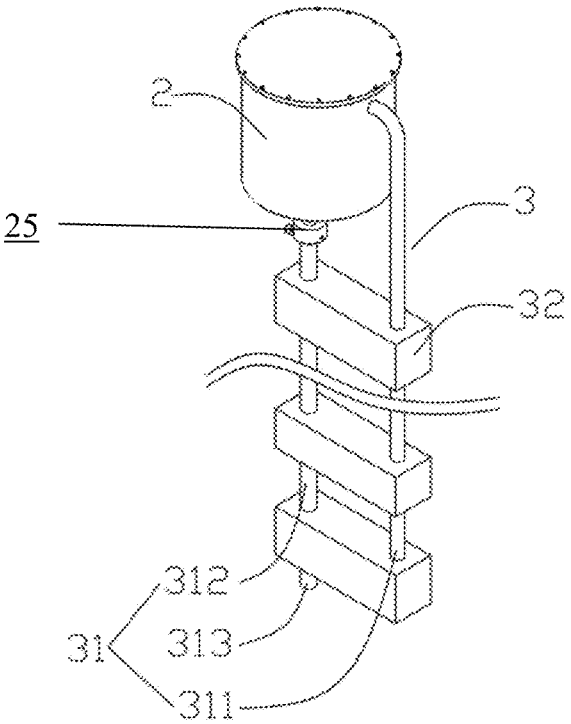
FIG. 16 is a structural schematic diagram of the golf-type gas lift ball gas lift oil production device in Embodiment 9 of the present disclosure.

As shown in FIG. 16, this Embodiment relates to a golf-type gas lift ball gas lift oil production device, consisting of the golf-type gas lift ball 1 in Embodiment 1, the ball retrieving and pitching device 2 in Embodiment 3 and the multistage start-up device 3 in Embodiment 5.

In light of the golf-type gas lift ball gas lift oil production device, the golf-type gas lift ball 1 is moved by the ball retrieving and pitching device 2 to the multistage start-up device 3, so that the oil and gas are moved from the multistage start-up device 3 up to the ball retrieving and pitching device 2. With this kind of circulation, the oil and gas can be lifted.

Embodiment 10

Figure 17:
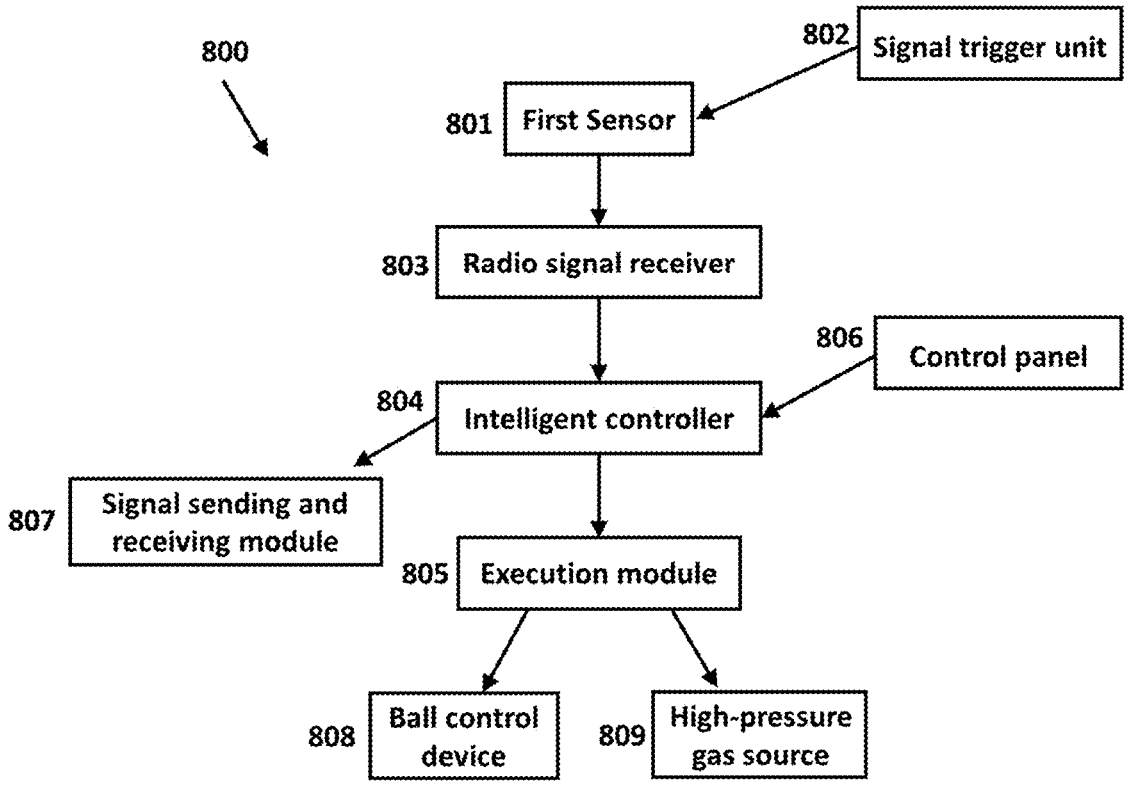
FIG. 17 is a block diagram of the intelligent control system for the golf-type gas lift ball gas lift oil production device in Embodiment 10 of the present disclosure.
Figure 18:
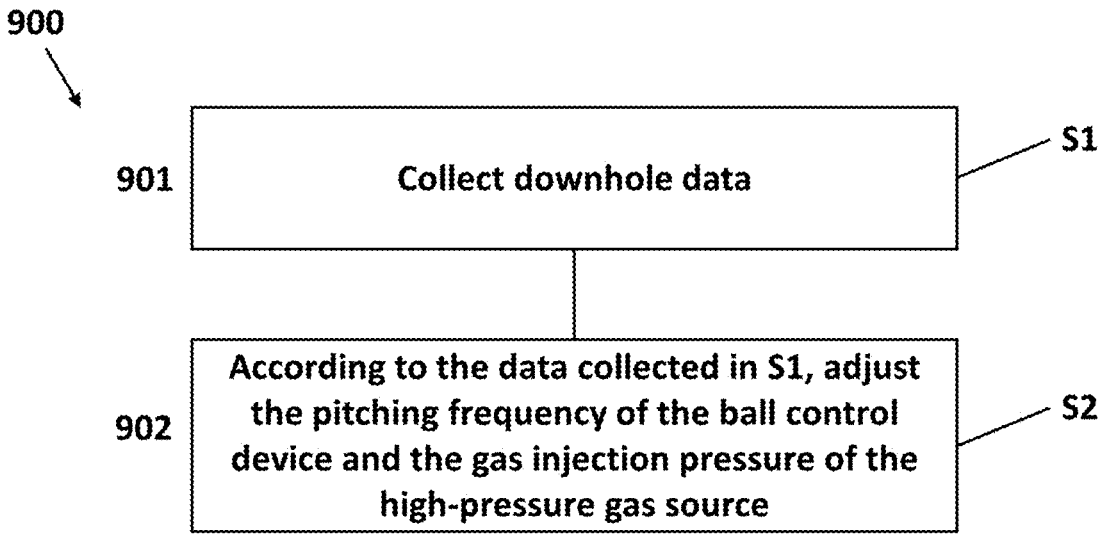
FIG. 18 is a block diagram of the intelligent control method for the golf-type gas lift ball gas lift oil production device in Embodiment 10 of the present disclosure.

As shown in FIGS. 17 to 18, this Embodiment relates to an intelligent control system and an intelligent control method of the golf-type gas lift ball gas lift oil production device, for controlling the golf-type gas lift ball gas lift oil production device and linking the golf-type gas lift ball, the ball retrieving and pitching device and the multistage start-up device together, wherein the intelligent control system 800 comprises:

- A first sensor 801 embedded in the golf-type gas lift ball and designed to collect dynamic position data;
- A signal trigger unit 802 designed to trigger the first sensor to send out signals;
- A radio signal receiver 803 designed to receive radio signals from the first sensor and convert these signals into digital signals;
- An intelligent controller 804 designed to receive digital signals from the radio signal receiver and generate control instructions;
- An execution module 805 designed to convert the control instructions from the intelligent controller for the ball retrieving and pitching device 808 to automatically pitch the ball and the high-pressure gas pump 809 to automatically inject gas;

A control panel 806 designed to display the system status and enter control data;

A signal sending and receiving module 807 designed to send the dynamic position data collected to a platform or the ground surface in the form of radio signals, and receive the control instructions from the platform or the ground surface.

The intelligent control method 900 comprises:

S1. Collect 901 dynamic downhole data;

The dynamic position data include pressure, temperature and moving velocity of the ball;

S2. According to the data collected in S1, adjust 902 the pitching frequency of a ball control device and the gas injection pressure of a high-pressure gas source;

X=pressure, Y=temperature and Z=velocity;

A=pitching frequency of the ball retrieving and pitching device and B=gas injection pressure of the high-pressure gas pump.

The embodiments above are only the preferred embodiments for the present disclosure and not used to restrict the present disclosure. Those of skill in the art may make various modifications and variations to the present disclosure. Any modifications, equivalent replacements and improvements made within the spirit and principle of the present disclosure shall fall into the scope of protection of the present disclosure.

The invention claimed is:

1. A gas lift ball for lifting oil and/or gas in a gas lift tee with power provided by pressurized gas in the gas lift tee, the gas lift ball comprising:

a spherical body configured with a diameter less than inner diameters of a gas supply pipe and a gas lift pipe of the gas lift tee, and a plurality of protrusions on an outer wall of the spherical body.

2. The gas lift ball according to claim 1, wherein the outer diameter of the gas lift ball is less than the inner diameters of the gas supply pipe and the gas lift pipe when the protrusions are substantially non-deformable, pointed pieces.

3. The gas lift ball according to claim 1, wherein the outer diameter of the gas lift ball is more than or equal to the inner diameters of the gas supply pipe and the gas lift pipe when the protrusions are deformable burrs that deform and attach to an inner wall of the gas lift pipe or the gas supply pipe upon entering the gas lift pipe or the gas supply pipe.

4. The gas lift ball according to claim 1, wherein the spherical body is hollow, and the spherical body includes an interconnecting hole formed on the sidewall of the spherical body, a layer is arranged on an inner sidewall of the spherical body, and a first sensor comprising a pressure sensor, a temperature sensor and/or a velocity sensor is embedded in the layer.

5. A ball retrieving and pitching device for retrieving and pitching the gas lift ball according to claim 1, wherein the ball retrieving and pitching device comprises a housing, a ball inlet, a ball outlet, a gas outlet and an oil outlet are formed on the housing, the ball inlet is located above the ball outlet, a slide rail for the gas lift ball is formed between the ball inlet and the ball outlet, one end of the slide rail is connected with the ball inlet while the other end thereof is connected with the ball outlet, the inner diameter of the slide rail is more than the inner diameter of the ball outlet, a plurality of gaps are formed on the sidewall of the slide rail, and a pressure conversion valve is installed at an end of the ball outlet.

6. The ball retrieving and pitching device according to claim 5, wherein the slide rail is spiral and comprises a conveyor pipe and an open slide rail, the open slide rail comprises circular rings and four metal bars, the circular rings are arranged at the ends of the metal bars, the four metal bars are arranged in an annular form, a plurality of supports with a plurality of fixed collars are arranged on the slide rail, the fixed collars are sleeved on the outer wall of the slide rail, and fixing rods are arranged among the fixed collars.

7. The ball retrieving and pitching device according to claim 5, wherein an annular gas lift ball retrieving and storage device with the same inner diameter as that of the ball outlet is installed at the end of the slide rail, the gas lift ball retrieving and storage device fits with the ball outlet and is connected to an automatic telescopic rod which is installed at the inner bottom of the housing, and the movement direction of the automatic telescopic rod is perpendicular to the axial direction of the gas lift ball retrieving and storage device.

8. The ball retrieving and pitching device according to claim 5, wherein the pressure conversion valve comprises a first chamber and a second chamber which are serially connected, the first chamber is connected to the ball outlet, a first valve is arranged between the first chamber and the ball outlet, a second valve is arranged between the first chamber and the second chamber, a third valve is arranged at the bottom of the second chamber, a first gas pump for providing the pressurized gas is connected to the second chamber, and a pressure relief port at which a fourth valve is installed is formed on the sidewall of the second chamber.

9. The ball retrieving and pitching device according to claim 5, wherein the pressure conversion valve comprises a spherical and hollow housing, with a ball inlet channel, a ball outlet channel, a gas channel and a residual oil channel formed on the sidewall of the spherical housing respectively; wherein the inner diameter of the ball inlet channel being equal to that of the ball outlet channel, and the inner diameter of the gas channel being less than that of the ball inlet channel, and the inner diameter of the residual oil channel being less than that of the gas channel; wherein a round valve core fitting with the inner wall of the spherical housing is installed in the spherical housing, with a first through hole and a second through hole formed coaxially at the axis of the valve core; wherein the first through hole and the ball inlet channel have equal inner diameters, and the second through hole and the gas channel have equal inner diameters; wherein a second gas pump for providing the pressurized gas is connected to the gas channel, and a rotary actuator, powered electrically or pneumatically, to drive the valve core to rotate is installed outside the spherical housing.

10. A multistage start-up device for multistage start-up in downhole operation of the gas lift ball according to claim 1, wherein the multistage start-up device comprises the gas lift tee, together with a plurality of gas lift valves arranged along the length of the gas lift tee;

the gas lift tee is in a Y shape, and comprises the gas supply pipe, the gas lift pipe, and the tailpipe;

the plurality of gas lift valves is in an H shape, and comprises a first channel, a second channel and a third channel, wherein the first channel is connected to the gas supply pipe, the second channel is connected to the gas lift pipe, the first channel and the second channel are connected together by the third channel, and the third channel is internally provided with a movable gate.

11. The multistage start-up device according to claim 10, wherein a sealing chamber with a fixed plate and a movable plate inside is arranged at the top of the third channel, a telescopic part is arranged between the fixed plate and the movable plate, a third through hole is formed between the sealing chamber and the third channel, the movable gate comprises a plate gate which passes through the third through hole, one end of the plate gate is fixedly connected to the movable plate, while the other end thereof comprises a free end at which a stop block is arranged.

12. The multistage start-up device according to claim 11, wherein the telescopic part is a spring; and a pressure transfer hole formed through a wall of the sealing chamber located between the second channel and the plate gates.

13. The multistage start-up device according to claim 11, wherein the telescopic part is motor-driven; and a first pressure sensor and a first PLC controller are arranged on the inner sidewall of the second channel respectively, wherein a signal output end of the first pressure sensor is connected to a signal input end of the first PLC controller, and the signal output end of the first PLC controller is connected to the signal input end of the motor-driven telescopic part.

14. The multistage start-up device according to claim 10, wherein the movable gate comprises a cylinder gate which comprises a valve core and a valve casing; the valve core and the valve casing are arranged coaxially, and the valve core is rotatable about an axis in the valve casing, and the outer wall of the valve core fits with the inner wall of the valve casing; a fourth through hole is formed on the valve core at a direction perpendicular to the axis, and slots fitting with the fourth through hole are formed symmetrically at both sides of the valve casing;

a second pressure sensor and a second PLC controller are arranged on the inner sidewall of the second channel respectively, wherein the signal output end of the second pressure sensor is connected to the signal input end of the second PLC controller, and the signal output end of the second PLC controller is connected to the signal input end of the cylinder gate.

15. The multistage start-up device according to claim 10, wherein a perforating gun and a sleeve are arranged at the lower end of the tailpipe;

the perforating gun is cylindrical, a first cable is arranged at the tail of the perforating gun, a plurality of storage grooves with perforating bullets inside are formed on the sidewall of the perforating gun, initiators are arranged at the tails of the perforating bullets, located at the central axis of the perforating gun and arranged in an annular form, fuses are embedded at the central axis of the perforating gun and pass through the inside of the initiators, and curved plates made of ductile metals are arranged at the openings of the storage grooves;

the sleeve with a heater inside is sleeved outside the perforating gun, wherein a second cable is connected to the heater, a heating wire with one end fixedly connected to the heater and the other end fixedly connected to the curved plates is arranged between the sleeve and the perforating gun, a plurality of perforating bullet outlets are formed on the sidewall of the sleeve, the perforating bullet outlets fit with the storage grooves, and metal foils are arranged at the perforating bullet outlets.

16. The multistage start-up device according to claim 15, wherein the curved plates are fixed at the openings of the storage grooves or the perforating bullet outlets by means of spot-welding.

17. The multistage start-up device according to claim 15, wherein a plurality of first motor-driven telescopic rods are arranged on the outer sidewall of the perforating gun, and a plurality of recesses fitting with the first motor-driven telescopic rods are formed on the inner sidewall of the sleeve; a plurality of second motor-driven telescopic rods are arranged on the outer sidewall of the sleeve, and burrs are formed at the ends of the second motor-driven telescopic rods.

18. A gas lift ball gas lift oil production device, comprising:

a gas lift ball for lifting oil and/or gas in a gas lift tee with power provided by pressurized gas in the gas lift tee;

a ball retrieving and pitching device; and a multistage start-up device;

wherein the gas lift ball comprises a spherical body configured with a diameter less than inner diameters of a gas supply pipe and a gas lift pipe of the gas lift tee, and a plurality of protrusions on an outer wall of the spherical body;

wherein the ball retrieving and pitching device comprises a housing, a ball inlet, a ball outlet, a gas outlet and an oil outlet are formed on the housing, the ball inlet is located above the ball outlet, a slide rail for the gas lift ball is formed between the ball inlet and the ball outlet, one end of the slide rail is connected with the ball inlet while the other end thereof is connected with the ball outlet, the inner diameter of the slide rail is more than the inner diameter of the ball outlet, a plurality of gaps are formed on the sidewall of the slide rail, and a pressure conversion valve is installed at an end of the ball outlet; and wherein the multistage start-up device comprises the gas lift tee, together with a plurality number of gas lift valves arranged along the length of the gas lift tee; the gas lift tee is in a Y shape, and comprises the gas supply pipe, the gas lift pipe and the tailpipe; the plurality of gas lift valves are in an H shape, and comprises a first channel, a second channel and a third channel, wherein the first channel is connected to the gas supply pipe, the second channel is connected to the gas lift pipe, the first channel and the second channel are connected together by the third channel, and the third channel is internally provided with a movable gate.

19. An intelligent control system of the gas lift ball gas lift oil production device, for controlling the gas lift ball gas lift oil production device according to claim 18 and linking the gas lift ball, the ball retrieving and pitching device and the multistage start-up device together, wherein the intelligent control system comprises:

a first sensor embedded in the gas lift ball and designed to collect dynamic position data;

a signal trigger unit designed to trigger the first sensor to send out signals;

a radio signal receiver designed to receive radio signals from the first sensor and convert these signals into digital signals;

an intelligent controller designed to receive digital signals from the radio signal receiver and generate control instructions; and a control panel designed to display the system status and enter control data, wherein the intelligent control system is further configured to:

convert the control instructions from the intelligent controller for the ball retrieving and pitching device to automatically pitch the ball and for the gas pump for providing the pressurized gas to automatically inject the pressurized gas; and send the dynamic position data collected to a platform or the ground surface in the form of radio signals, and receive the control instructions from the platform or the ground surface.

20. An intelligent control method of the gas lift ball gas lift oil production device, for controlling the gas lift ball gas lift oil production device according to claim 18 and linking the gas lift ball, the ball retrieving and pitching device and the multistage start-up device together, wherein the intelligent control method comprises:

S1. Collect dynamic downhole data;

the dynamic downhole data include pressure, temperature and moving velocity of the ball;

S2. According to the data collected in S1, adjust the pitching frequency of a ball control device and the gas injection pressure of a gas source.

* * * * *